United States Patent [19]

Partridge

[11] 4,373,300

[45] Feb. 15, 1983

[54] APPARATUS FOR COLLECTING PARTICLES PRODUCED DURING ABRADING OF PRECIOUS METALS

[76] Inventor: Lyle D. Partridge, 507 Mustang Rd., Heber Springs, Ark. 72543

[21] Appl. No.: 183,254

[22] Filed: Sep. 2, 1980

[51] Int. Cl.[3] ..... B24B 55/00

[52] U.S. Cl. ..... 51/270; 53/467; 53/428

[58] Field of Search ..... 51/268, 270, 281 R; 29/DIG. 79; 433/92; 164/59.1, 57.1, 56.1; 206/366, 210; 53/467, 428, 377, 387

[56] References Cited

U.S. PATENT DOCUMENTS

| | | | |
|---|---|---|---|
| 890,005 | 6/1908 | Wright | 51/270 |
| 1,007,272 | 10/1911 | Crease | 51/270 |
| 1,374,075 | 4/1921 | Graham | 51/270 |
| 2,723,513 | 11/1955 | Slonneger | 51/270 |
| 3,633,815 | 1/1972 | Rosenburg | 229/44 |
| 3,863,392 | 2/1975 | Haker | 51/270 |
| 3,876,067 | 4/1975 | Schwarz | 206/366 |
| 4,120,121 | 10/1978 | Surman | 51/270 |

FOREIGN PATENT DOCUMENTS

| | | | |
|---|---|---|---|
| 881624 | 12/1962 | France | 164/56.1 |
| 825087 | 12/1959 | United Kingdom | 164/56.1 |

*Primary Examiner*—Roscoe V. Parker
*Attorney, Agent, or Firm*—Tod R. Nissle

[57] ABSTRACT

A container for capturing and facilitating the processing of particles produced during the abrading of a substance. The container comprises at least one surface formed to receive the particles produced during the abrading of the substance, a mechanism for retaining the particles contacting the surface and at least one material having at least one physical property altered during the normal processing of the collected particles such that the particles are separated from the container, where normal processing generally effects the consolidation and refining of the collected particles.

2 Claims, 12 Drawing Figures

APPARATUS FOR COLLECTING PARTICLES PRODUCED DURING ABRADING OF PRECIOUS METALS

This invention relates to an improved receptacle and method for collecting particles produced during the abrading of a precious metal.

In another and more specific respect, the invention pertains to an improved collector and method for capturing particles produced during the abrading of a precious metal which facilitates separation of particles from the collector during normal processing undertaken to consolidate and refine the captured particles.

In yet another respect the invention pertains to an improved collector for capturing particles produced during the working of precious metal which baffles the movement of particles striking the collector and minimizes the number of abraded particles which, after contacting the collector, rebound therefrom onto the surface area surrounding and supporting the collector.

In still another respect the invention pertains to an improved collector for capturing particles produced during the abrading of a precious metal which is virtually maintenance free, disposable, lightweight and inexpensive to manufacture.

In a further aspect the invention relates to an improved collector for capturing particles produced during the abrading of a precious metal which is readily sealed so the collector may be utilized to store and transport captured particles.

Receptacles for collecting particles produced during the abrading or working of precious metals are well known in the art. For example, see U.S. Pat. Nos. 890,005 to Wright, 1,007,272 to Crease, 1,374,075 to Graham and 4,120,121 to Surman. The apparatus disclosed in these references are provided with hoods or back stops to capture particles thrown from precious metal during grinding or working of the metal. Since the rear hood surfaces against which the particles impinge generally have smooth relatively hard surfaces, the hoods are commonly provided with side guards to contain particles which glance off of the interior rear surface. Captured metal particles are segregated in a drawer or other container which is periodically emptied.

In order to minimize the tendency of particles to rebound from the interior hood surface, hoods lined with felt and other resilient materials have been developed. However, recovering particles which strike these surfaces is time-consuming and inconvenient. The particles must be washed or scraped from the surfaces. A further disadvantage of these types of hood linings is that a portion of the metal particles thrown against the linings are embedded in the linings and are not, practically speaking, retrievable.

Each of the systems described in the above noted references is intended for long-term use, and, in addition, requires periodic cleaning and removal of accumulated metal particulate. Providing these devices with drawers or other movable parts which facilitate the accumulation and storage of metal particles increases the cost of manufacturing the device. The complicated retrieval apparatus disclosed in the Surman reference (U.S. Pat. No. 4,120,121) exemplifies this problem. Precious metal particles removed from the collector devices are normally sold to vendors who consolidate and refine the particles.

Accordingly, it would be highly desirable to provide a collector for capturing particles produced during the abrading of a material which was essentially maintenance free and which could, without requiring the user to remove captured particles therefrom, be utilized in the normal processing undertaken to consolidate and refine the particles.

Therefore, it is a principal object of the invention to provide an improved collector and method for capturing particles produced during the working of a precious metal.

A further object of the invention is to provide an improved disposable collector for capturing particles which may be utilized during normal processing undertaken to consolidate and refine the particles.

Another object of the instant invention is to provide an improved collector for capturing abraded particles of a precious material which is essentially maintenance free and does not require the user to periodically retrieve particles of precious metal accumulated in the collector.

A further object of the invention is to provide an improved collector for capturing particles produced during the abrading of a material which baffles the movement of particles striking the collector and minimizes the likelihood of metal particles rebounding from the collector onto the surface surrounding and supporting the collector.

Still another object of the present invention is to provide an improved collector for receiving particles emitted during the working of a material which may be readily and conveniently sealed for storing and shipping captured particles.

These and other, further and more specific objects and advantages of the invention will be apparent to those skilled in the art from the following detailed description thereof, taken in conjunction with the drawings, in which.

Briefly, in accordance with one presently preferred embodiment of my invention, I provide, in combination with apparatus for abrading a substance, collecting means for capturing and facilitating the processing of particles abraded from the substances. The collecting means comprises at least one surface shaped, contoured and dimensioned to receive the particles produced during the abrading of the substance, means for retaining the particles contacting the surface, and at least one material having at least one physical property altered during the normal processing of the collected particles such that the particles are separated from the collecting means, the processing generally affecting the consolidation and refining of the collected particles.

In another embodiment of my invention I provide the method of collecting particles produced during the abrading of a substance, comprising the steps of positioning a collector to capture the particles produced, the collector being fabricated from at least one material having at least one physical property altered during the normal processing of the collected particles such that the particles are separated from the collector, the processing generally effecting the consolidation and refining of the collected particles, and abrading the material.

In still another embodiment of my invention I provide, in combination with apparatus for abrading a substance, a collector for capturing particles produced during the abrading of the substance and for minimizing the number of particles which contact the collector and rebound therefrom onto the area surrounding the collector. The collector comprises at least one baffle member having a plurality of elongate members arranged such that at least one group of the panel members are generally parallelably disposed with respect to one another, the upper edges thereof form a generally striated surface for receiving the particles, and each of the particles captured by the collector downwardly falls between an adjacent pair of the panel members. The elongate members each have at least a pair of generally planar surfaces.

Figure 1:
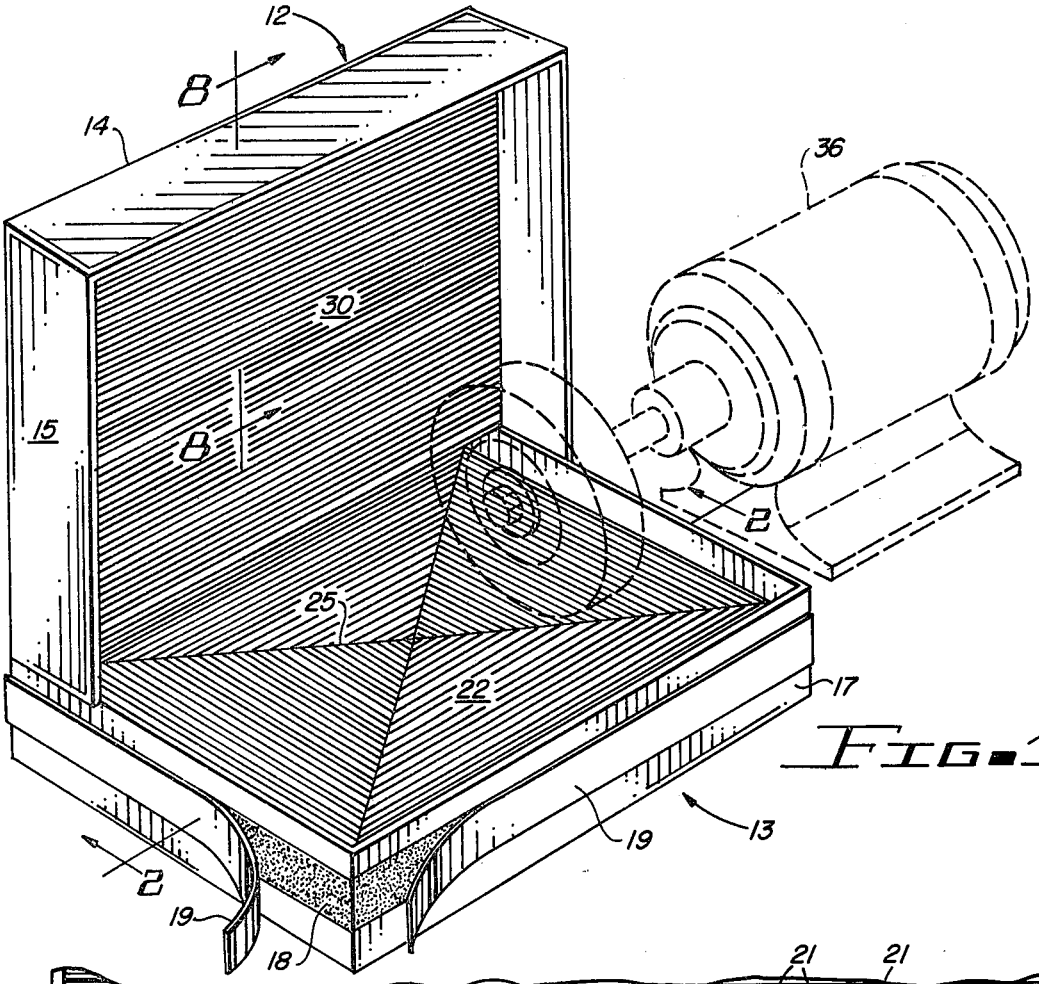
FIG. 1 is a perspective view of a collector constructed in accordance with the presently preferred embodiment of the invention illustrating the use thereof in conjunction with conventional abrading apparatus.
Figure 2:
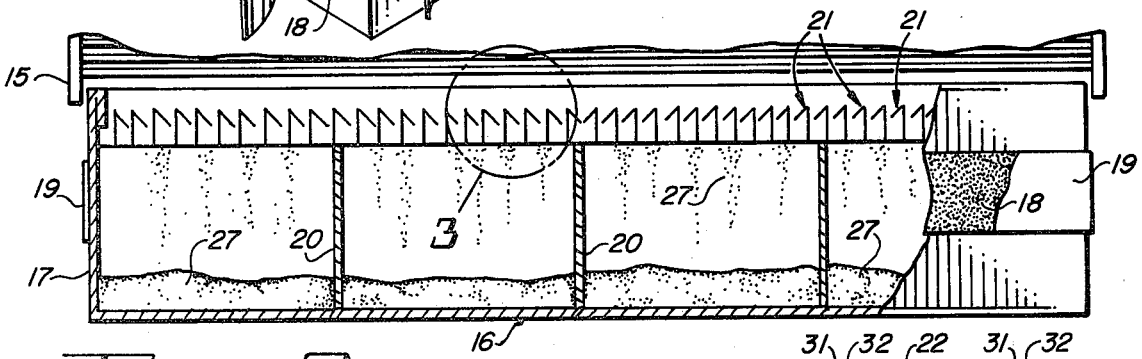
FIG. 2 is a sectional view of the collector of FIG. 1 taken along section line 2—2 thereof illustrating the interior construction thereof.
Figure 3:
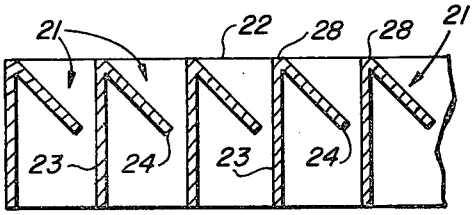
FIG. 3 is an enlarged view of a portion of the collector of FIG. 2 illustrating details of the construction of the particle capturing surface thereof.

Turning now to the drawings, which depict the presently preferred embodiments of the invention for the purpose of illustrating the practice thereof and not by way of limitation of the scope of the invention and in which like characters indicate corresponding elements throughout the several views, FIGS. 1–3 illustrate a collector constructed in accordance with the invention and comprising lid 12 movably attached to base 13. Base 13 includes panel members 16 having upwardly projecting interconnected side panels 17. Top 14 of lid 12 is provided with projecting depending flaps 15 which enclose sides 17 and base 13 when lid 12 is closed. Adhesive strip surfaces 18 along sides 17 of base 13 are protected by removable tape strips 19. Ribs 20 positioned at intervals along bottom panel 16 of base 13 support elongate panel members 21 having upper edges 28 which form a striated particle capturing surface 22. As shown in FIG. 3, each panel member 21 includes a vertically disposed member 23 having depending downwardly projecting leg 24. Either end of each panel member 21 is attached along seam 25 to the end of an adjacent panel member 21. Panel members 21 are spaced such that particules 27 downwardly travel between angled legs 24 and upstanding members 23 and accumulate on the bottom panel 16 of base 13.

Figure 8:
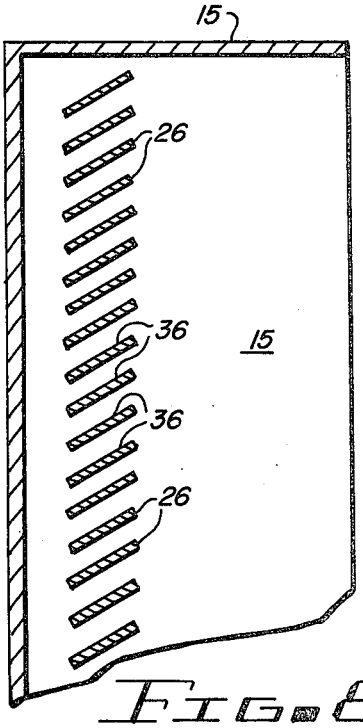
FIG. 8 is a sectional view of the lid of the collector of FIG. 1 taken along section line 8—8 to illustrate the interior construction thereof.
Figure 10:
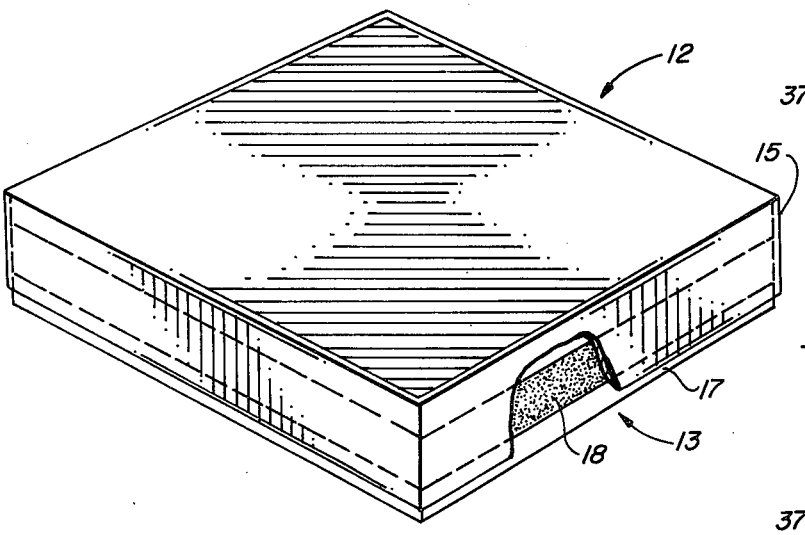
FIG. 10 is a perspective view of the collector of FIG. 1 further illustrating the mode of operation thereof.

The arrangement of elongate panel members 26 in lid 12 is illustrated in FIG. 8. When lid 12 is open, panel members 26 are upwardly angled so that particles contacting planar surfaces 36 are downwardly directed between a pair of adjacent panel members 26. Either end of each panel member 26 is attached to a side 15 of lid 12.

Figure 4:
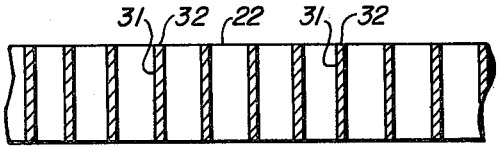
FIG. 4 is a side view of an optional alternate construction of the particle capturing surfaces of the collector of FIG. 1.
Figure 5:
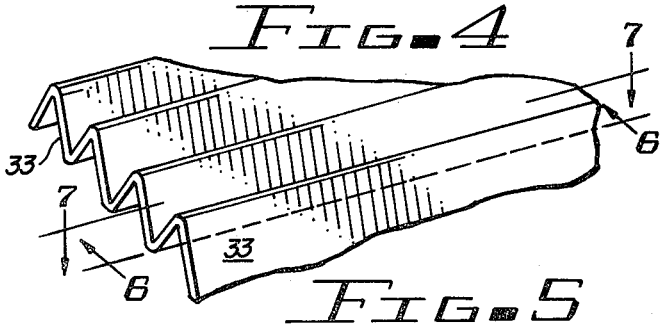
FIG. 5 is a perspective view of another optional construction of the particle capturing surfaces of the collector of FIG. 1.
Figure 6:
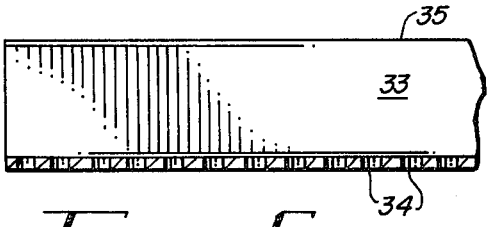
FIG. 6 is a sectional view of the particle capturing surface of FIG. 5 taken along section line 6—6 thereof.
Figure 7:
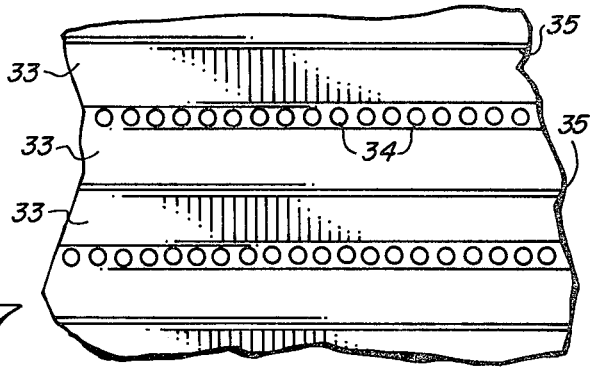
FIG. 7 is a top view of the particle capturing surface of FIG. 5.

Each elongate panel member is provided with at least a pair of planar surfaces. As would be appreciated by those skilled in the art, groups of elongate panel members may be combined in numerous arrangements and attitudes to form particle receiving surfaces 22 and 30. One such optional arrangement is shown in FIG. 4 where striated surface 22 is formed by the upper edges 32 of equally spaced elongate planar members 31. Another alternate arrangement of elongate panel members is, as illustrated in FIGS. 5–7, achieved by attaching elongate members 33 edge to edge in a zig-zag fashion. Particles falling between two adjacent members 33 pass through apertures 34 and on to panel 16 of base 13. Upper edges 35 form striated surface 22.

In use, the collector is, as shown in FIG. 1, placed adjacent abrading apparatus, indicated by dashed lines 36, to receive particles produced during the polishing or grinding or a precious metal or material. After a substantial amount of particules have accumulated in the collector, protective strips 19 are removed, lid 12 closed, and flaps 15 placed against exposed adhesive surfaces 18 to seal the container for storage or shipping.

In contrast to a generally smooth planar surface, striated surfaces 22 and 30 tend to baffle movement of particles contacting the collector and to reduce the frequency with which a particle glances off of the collector and on to the countertop or floor. This baffling effect occurs because a substantial portion of particles are deflected from the initial panel member contacted onto at least one other adjacent panel member. This double deflection is generally sufficient to absorb the inertia of a particle and to cause it to drop between panel members onto the floor of the collector. Further, when a particle contacts an upper edge of a panel member, it is unlikely the particle can, as it may on a smooth planar surface, cleanly glance off the edge and out of the collector. Instead, the particle is normally directed into a neighboring panel member.

In order to achieve the above described baffling effect, it is not critical that the elongate panel members be closely spaced. Nor need the striations formed by the upper edges of the panel members be uniformly parallel to one another. Also, as shown in FIG. 1, numerous striation designs may be formed by the upper edges of the elongate panel members. And, the panel members may be curved along their length, as in FIG. 9, or along their height.

Although the invention may be conveniently employed to collect particles produced in working a variety of materials, a collector constructed in accordance with the invention and fabricated from paper or cardboard is especially useful in capturing particles produced during the working of gold. After a substantial amount of gold particles have been accumulated, the collector may be sealed and delivered to a refinery. The paper or cardboard collector can, without any harmful effects, be burned during the normal process of refining the gold particles.

In order to facilitate the processing of particles collected during the abrading of various other substances, a collector constructed in accordance with the invention could be fabricated in whole or in part from materials which would allow the collector to be destroyed or otherwise altered during the consolidation and refining of a particular substance such that collected particles would be freed from the collector.

Figure 9:
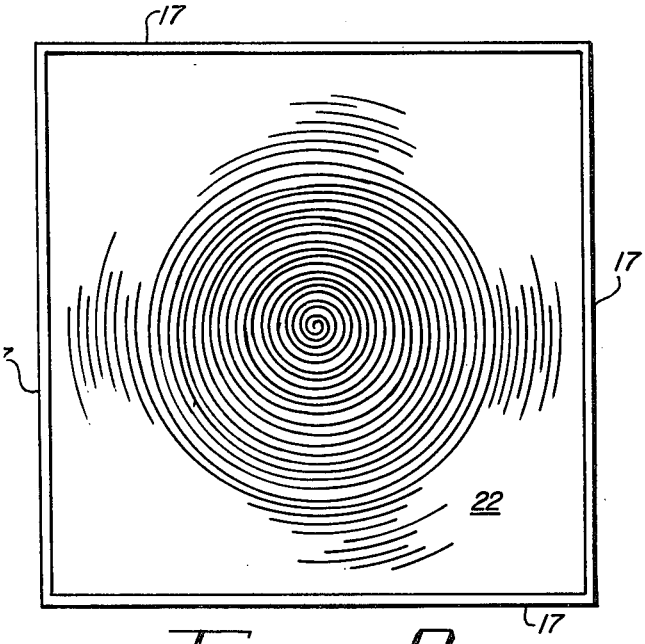
FIG. 9 is a top view of an alternate construction of the particle capturing surfaces of the collector of FIG. 1.
Figure 11:
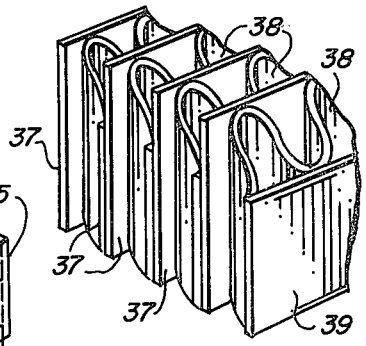
FIG. 11 is a perspective view of an alternate construction of the particle capturing surfaces of the collector of FIG. 1.
Figure 12:
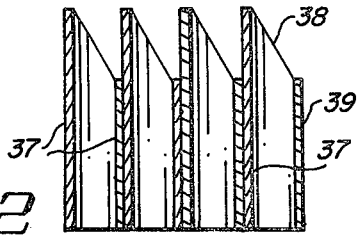
FIG. 12 is a side view of the alternate construction of particle capturing surfaces of FIG. 11.

As shown in FIGS. 9, 11 and 12, the particle capturing surfaces of such a collector could be formed by winding corrugated cardboard having elongate panel members 37 parallelably attached by curved members 38. Each panel member 37 would have a pair of elongate planar surfaces 39.

Having described my invention in such terms as to enable those skilled in the art to understand and practice it, and having identified the presently preferred embodiments thereof,

I claim:

1. In combination with apparatus for abrading a substance, a degradable collector for capturing particles separated from said substance during said abrading thereof, and minimizing the number of particles which contact said collector and rebound therefrom onto the area surrounding said collector, said collector comprising a thermally or chemically destructible container including a hollow base having adhesive means on the exterior sides thereof; a lid having one end pivotally connected to said base along one side thereof and depending flaps movable with said lid to a container closing position engaging said adhesive means; said base and lid each including a baffle member having a plurality of spaced elongate panel members, each of said elongate panel members having a pair of opposed planar surfaces co-terminating along an edge defining at least in part the periphery of said panel member, said elongate panel members being spaced such that (a) at least one group of said elongate panel members are generally parallelably disposed with respect to one another, (b) said edges thereof define a striated surface for receiving and capturing said particles produced during the abrading of said substance, and (c) each of said particles captured by said baffle members downwardly falls into a space between an adjacent pair of said elongate panel members, (d) said baffle member of said lid and said base, each being disposed in spaced relation to the adjacent surface of its respective lid or base so as to define communicating chambers when said lid is in the open position.

2. The apparatus of claim 1 wherein said edges comprise less than 50% of the surface area of said striated surface.

* * * * *